US005937850A

United States Patent [19]

Kawashima et al.

[11] Patent Number: 5,937,850

[45] Date of Patent: Aug. 17, 1999

[54] SNORKEL WITH EXHALATION VALVE

[75] Inventors: Haruo Kawashima; Kenji Kawana, both of Tokyo, Japan

[73] Assignee: Tabata Co., Ltd., Tokyo, Japan

[21] Appl. No.: 09/013,217

[22] Filed: Jan. 26, 1998

[30] Foreign Application Priority Data

Jan. 28, 1997 [JP] Japan ..... 9-13839

[51] Int. Cl.[6] ..... A62B 7/00

[52] U.S. Cl. ..... 128/201.11; 128/205.24

[58] Field of Search ..... 128/201.27, 201.28, 128/201.11, 205.24

[56] References Cited

U.S. PATENT DOCUMENTS

| | | | |
|---|---|---|---|
| 4,834,084 | 5/1989 | Walsh . | |
| 4,838,262 | 6/1989 | Katz | 128/205.25 |
| 5,261,396 | 11/1993 | Faulconer et al. | 128/201.11 |
| 5,487,379 | 1/1996 | Koshiishi | 128/201.11 |

FOREIGN PATENT DOCUMENTS 49-33039 9/1974 Japan .

*Primary Examiner*—John G. Weiss
*Assistant Examiner*—Charles W. Anderson
*Attorney, Agent, or Firm*—Lowe Hauptman Gopstein Gilman & Berner

[57] ABSTRACT

A bottom of a mouthpiece 2 of a snorkel comprises a first base plate 16 having through-holes 22 for drainage and against which a non-return valve 7 bears from the outside, second base plates 17 spaced from the first base plate 16 toward a top of the snorkel so as to cover the through-holes and supports 18 extending between the first plate 16 and each of the second base plates 17. The interior of the mouthpiece 2 drainably communicates with the exterior thereof through openings defined between the first base plate 16 and each of the second base plates 17 and the through-holes 22, when the non-return valve 7 is opened.

5 Claims, 3 Drawing Sheets

SNORKEL WITH EXHALATION VALVE

BACKGROUND OF THE INVENTION

This invention relates to a swimmer's snorkel to be used during swimming.

Japanese Utility Model Publication No. 1974-33039 discloses a snorkel in which a mouthpiece has on its top a part to be held in a swimmer's mouth and on its bottom, opposed to the top, through-holes for drainage, and is provided on the outside of the bottom with a non-return valve openably closing these through-holes. When a swimmer rises toward the water surface until the snorkel is partially exposed above the water surface, a quantity of water corresponding to the quantity of water remaining in a portion of the snorkel now exposed above the water surface is forced out from the snorkel through the non-return valve.

U.S. Pat. No. 4,834,084 discloses a snorkel in which an inner space of a mouthpiece in the form of a substantially U-shaped tube is partitioned into upper and lower spaces by a baffle plate extending horizontally inward from a tubular wall. A means to be held in a swimmer's mouth is formed above the baffle plate and a horizontally extending non-return valve is provided below the baffle plate and adapted to be opened or closed. The swimmer's exhalation strikes the baffle plate and does not act directly upon the non-return valve in the case of this snorkel. Therefore, the quantity of water remaining within the snorkel can be rapidly expelled through an upper opening of the snorkel by vigorous exhalation of the swimmer without opening the non-return valve unintentionally.

As noted above, the snorkel disclosed in U.S. Pat. No. 4,834,084 has a baffle plate extending inward from a tubular wall of the mouthpiece. Since the mouthpiece is generally molded by injection molding of thermoplastic material, a set of male and female dies for molding the baffle plate tends to be more complicated and a molding cycle must be often extended, particularly when the mouthpiece is in a U-shaped tubular form having therein the baffle plate. Manufacturing cost is inevitably increased in this case.

SUMMARY OF THE INVENTION

In view of the problem described above, it is a principal object of the invention to provide a snorkel with a relatively simple construction for preventing a swimmer's exhalation from acting directly upon the non-return valve provided within the mouthpiece.

The object set forth above is achieved, according to the invention, by a snorkel comprising an upper pipe having an opening to be located above the water surface and a mouthpiece lying under the water surface during snorkel use. An intermediate pipe extending between the upper pipe and the mouthpiece allows for passage of air as well as water therebetween. The mouthpiece has on its top a breathing seat adapted to be held in a swimmer's mouth and on its bottom a non-return valve adapted to be opened by the swimmer's exhalation. The snorkel bottom comprises a first base plate having through-holes allowing the mouthpiece interior to communicate with the exterior thereof and against which the non-return valve bears from the outside to open or close the through-holes. Second base plates spaced from the first base plate toward the top of the mouthpiece covers the through-holes from the inside and supports extend between the first base plate and each of the second base plates so as to keep them vertically spaced from each other so that the interior of the mouthpiece drainably communicates with the exterior thereof through the through-holes and openings defined between the first base plate and each of the second base plates when the non-return valve is opened.

DESCRIPTION OF THE PREFERRED EMBODIMENT

Details of the snorkel according to the invention will be more fully understood from the description given hereunder in reference to the accompanying drawings.

Figure 1:
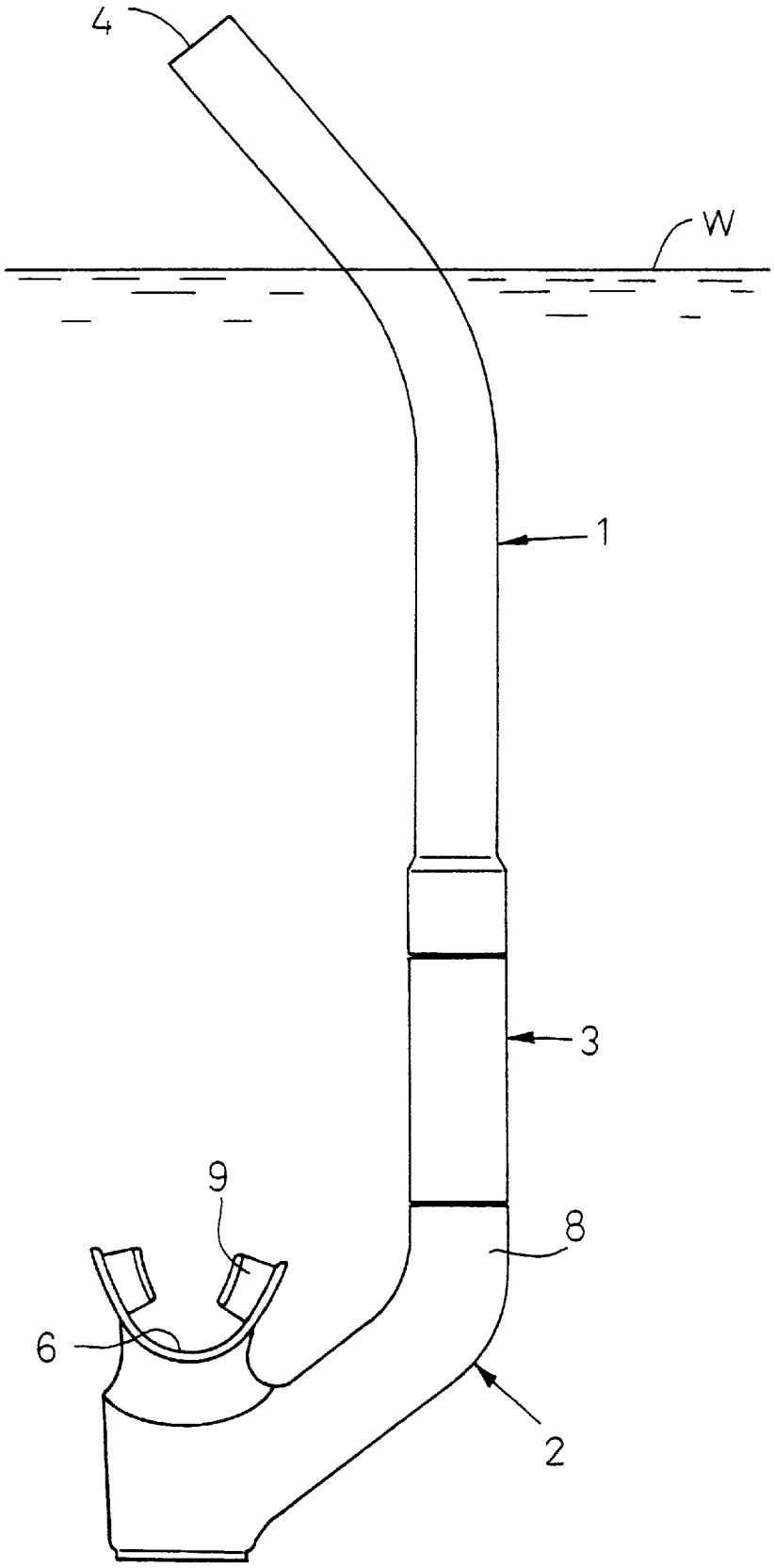
FIG. 1 is a side view of a snorkel.

A snorkel shown by FIG. 1 together with the imaginary water surface W in a side view comprises an upper pipe 1, a mouthpiece 2 and an intermediate pipe 3 extending between these two components 1, 2. The upper pipe 1 has an opening 4 for draft and drainage adapted to be located above the water surface W when the snorkel is being used. The mouthpiece 2 is provided at its top with a breathing seat 6 and at its bottom with an outwardly openable non-return valve 7. An upper end of the intermediate pipe 3 is water-tightly coupled to a lower end of the upper pipe 1 and a lower end of the pipe 3 is water-tightly coupled to an upper end of a tubular portion 8 as an upward extension of the mouthpiece 2. When the snorkel is actually used, a pair of projections 9 formed on the top of the mouthpiece 2 may be held in a swimmer's mouth to locate the breathing seat 6 against the swimmer's lips. When the swimmer who has made a deep dive rises toward the water surface W until the opening 4 of the upper pipe 1 is exposed above the water surface W, a quantity of water corresponding to the quantity of water contained in a portion of the upper pipe 1 which is now exposed above the water surface W opens the non-return valve 7 and flows out therethrough from the mouthpiece 2. A quantity of water remaining within the snorkel is then expelled out through the opening 4 by vigorous exhalation of the swimmer into the mouthpiece 2 through the breathing seat 6.

Figure 2:
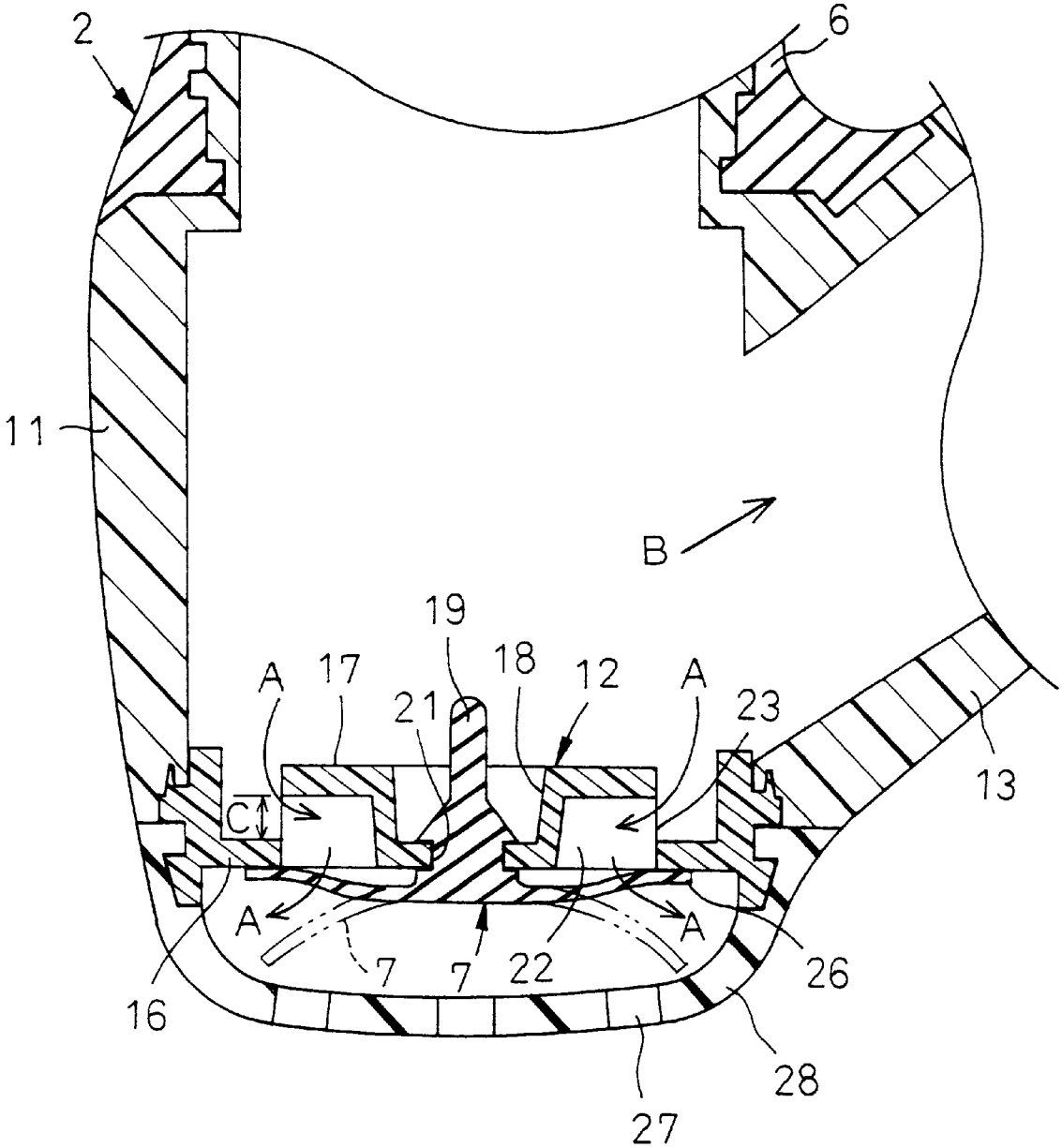
FIG. 2 is an exploded fragmentary side view of a part of the snorkel.

FIG. 2 is a sectional view of the mouthpiece 2 forming a part of the snorkel taken along a plane parallel to the plane defined by the sheet of this figure and dividing the mouthpiece 2 in two.

Figure 3:
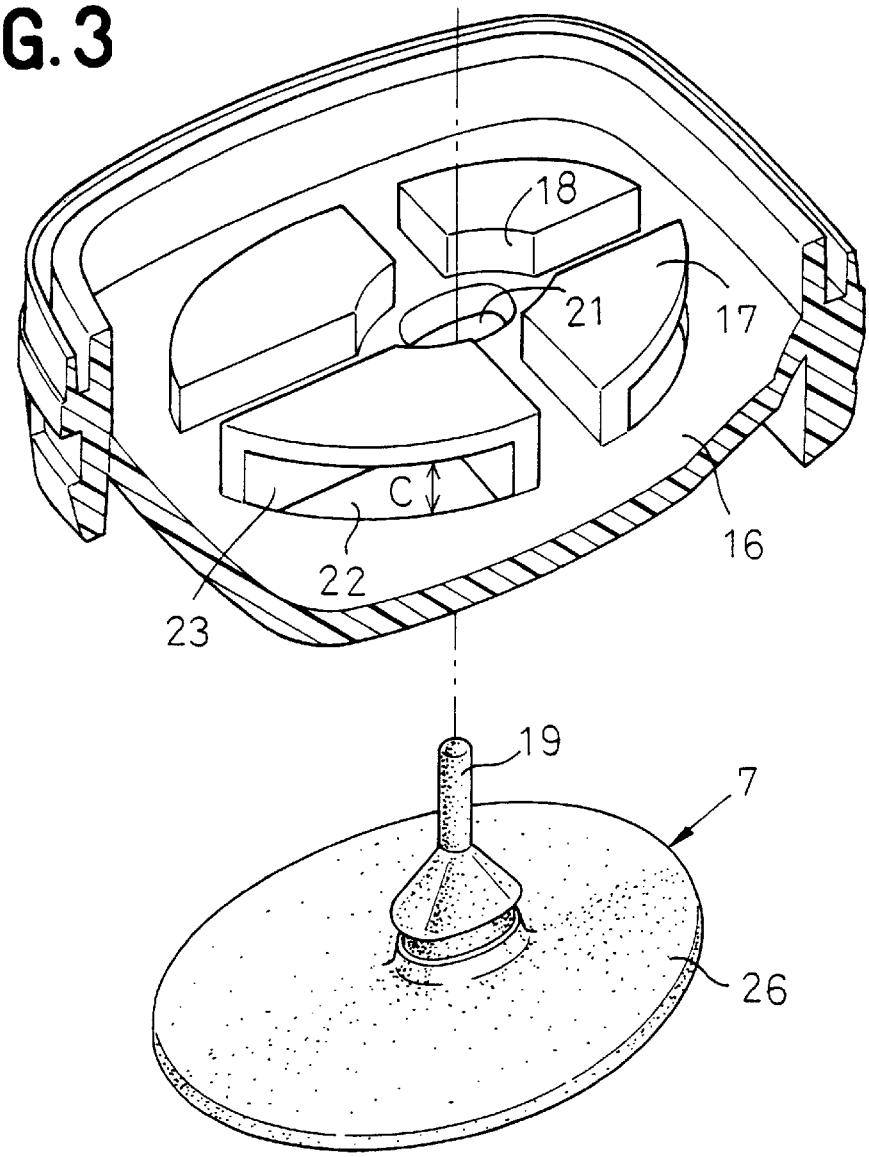
FIG. 3 is an exploded fragmentary perspective view of a mouthpiece.

FIG. 3 is an exploded perspective view showing a base plate assembly 12 defining the bottom of the mouthpiece 2 as partially broken away.

Referring to FIGS. 2 and 3, the mouthpiece 2 comprises breathing seat 6 made of soft plastic, a cylindrical member 11 made of hard plastic, the base plate assembly 12 made of hard plastic, and the non-return valve 7 made of soft plastic and detachably mounted on the base plate assembly 12. The breathing seat 6 has its upper part opening toward the swimmer's mouth and a lower part connected to an upper part of the cylindrical member 11. The cylindrical member 11 comprises, in turn, a tubular extending portion 13 slanting upwardly from its side wall toward the intermediate pipe 3 and is provided at its bottom with the base plate assembly 12. The base plate assembly 12 lies practically just below the breathing seat 6 and comprises a first base plate 16, a plurality of second base plates 17 upwardly spaced from the first base plate 16 toward the breathing seat 6, and supports 18 extending vertically between the first base plate 16 and each of the second base plates 17. The first base plate 16 has a central through-hole 21 for receiving a valve rod 19 of the non-return valve 7 so as to fix the valve 7, and a plurality of through-holes 22 for drainage which are intermittently arranged on a circle substantially concentric with the through-hole 21. The peripheral edge of the first base plate 16 is water-tightly fixed to the cylindrical member 11. The second base plates 17 cover the through-holes 22 as viewed in a top view of the mouthpiece 2. Each of the second base plates 17 has its inner peripheral edge connected to the support 18 rising from the first base plate 16 and its outer peripheral edge is spaced from the first base plate 16 by a distance of 0.5 mm or more to define an opening 23. The interior of the mouthpiece 2 drainably communicates with the exterior thereof through the openings 23 and the through-holes 22.

The non-return valve 7 comprises an oval sheet-like valve seat 26 and the valve rod 19 rising vertically from the center of the valve seat. The valve rod 19 may be inserted from the outside into the through-hole 21 of the first base plate 16 to bring the valve seat 26 in tight contact with the outer surface of the first base plate 16 to close the through-holes 22. A protective cover 28 (FIG. 2) made of hard plastic and having a plurality of through-holes 27 underlies the valve seat 26. This protective cover 28 may be optionally provided to prevent the valve seat 26 from being unintentionally opened due to contact with any obstacle during swimming. The protective cover 28 is detachably fixed along its peripheral edge to the peripheral edge of the first base plate 16 so as to be sufficiently spaced from the valve seat 26 to allow for the desired operation of the valve seat 26.

With the snorkel of the invention provided with mouthpiece 2, when the swimmer having made a dive rises again toward the water surface W until the opening 4 of the snorkel is exposed above the water surface W, the non-return valve 7 is opened outward as indicated by imaginary lines in FIG. 2 under the water pressure within the snorkel. Consequently a quantity of water flows out from the mouthpiece 2 as indicated by an arrow A until a water level within the snorkel falls substantially in line with the water surface W (See FIG. 1). Then, a vigorous exhalation of the swimmer into the mouthpiece 2 through the breathing seat 6 expels most of water contained within the snorkel out through the opening 4 and thereby enables snorkeling to be continued. With this mouthpiece 2, the vigorous exhalation does not act directly upon the non-return valve 7 covered with the second base plates 17 and therefore there is no apprehension that the exhalation might open the valve so widely as to disturb an effective drainage through the upper opening 4. The swimmer can efficiently utilize his or her breath exhalation to expel a quantity of water upward in a direction as indicated by an arrow B (See FIG. 2) for drainage.

Figure 4:
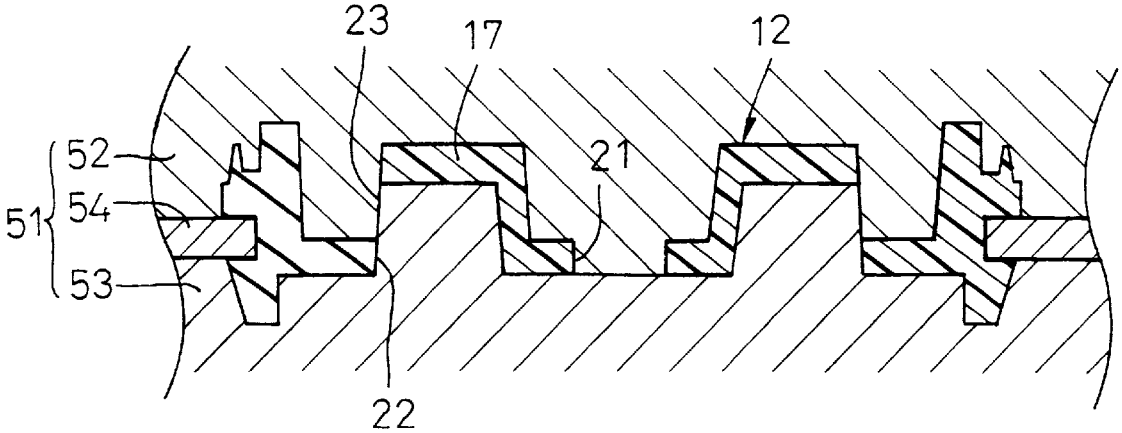
FIG. 4 is a fragmentary sectional view showing a base plate of the mouthpiece together with a set of dies for molding the plate.

FIG. 4 is a sectional view showing the base plate assembly 12 and a set of male and female dies used for injection molding of the assembly 12. The set 51 of the dies comprises an upper (male) die 52 and a lower (female) die 53, and the upper die 52 is provided with laterally movable slide cores 54. As will be apparent from FIG. 4, the through-holes 21, 22 as well as the opening 23 defining together the drainage passage can be easily obtained by butting or fitting the upper and lower dies 52, 53 against or to each other. As noted by persons skilled in the art of injection molding, the set 51 of the dies 52, 53 has a relatively simple construction and therefore does not cause serious extension of a molding cycle. Thus, the invention allows the mouthpiece 2 having an effective drainage function to be obtained without bearing a burden of manufacturing cost increase.

Having described the invention as related to the embodiment shown in the accompanying drawings, it is our intention that the invention be not limited by any of the details of description, unless otherwise specified, but rather be construed broadly within its spirit and scope as set out in the accompanying claims.

What is claimed is:

1. A snorkel, comprising an upper pipe having an opening adapted to be located above a water surface, a mouthpiece adapted to be under the water surface during use of the snorkel, and an intermediate pipe connecting the upper pipe and the mouthpiece to allow for passage of air as well as water between the mouthpiece and upper pipe, wherein the mouthpiece includes a breathing seat in an upper portion thereof adapted to be held in a swimmer's mouth and a non-return valve in a bottom thereof adapted to be opened by the swimmer's exhalation breath, the mouthpiece bottom including a first base plate having through-holes located above the non-return valve allowing an interior of the mouthpiece to communicate with an exterior thereof, an upper surface of the non-return valve being seated against the first base plate so as to open or close the through-holes, second base plates spaced above the first base plate in the direction of the mouthpiece upper portion and covering the through-holes from the inside, and supports extending between the first base plate and each of the second base plates to vertically space the same from each other so that the interior of the mouthpiece drainably communicates with the exterior thereof through the through-holes and openings defined between the first base plate and each of the second base plates when the non-return valve is opened.

2. The snorkel according to claim 1, wherein the first base plate, the second base plates, the through-holes and the non-return valve lie just below the breathing seat of the mouthpiece.

3. The snorkel according to claim 1, wherein the first base plate, the second base plates and the supports are molded into one piece of plastic material.

4. In a snorkel having a mouthpiece and a tube connected thereto for passage of air and water, and a non-return valve disposed in a bottom portion to selectively cover and uncover openings formed in the bottom portion, the improvement comprising a baffle plate formed with said openings and portions formed on said baffle plate in overlying relation to said openings between said openings and an upper portion of said mouthpiece.

5. In the snorkel of claim 4, further comprising an apertured protective cover formed below the non-return valve and defining a chamber therebetween adapted to receive the entire circumferential periphery of the valve in the open position thereof.

* * * * *